US007811054B2

(12) United States Patent
Eastman et al.

(10) Patent No.: US 7,811,054 B2
(45) Date of Patent: Oct. 12, 2010

(54) SHROUD CONFIGURATION HAVING SLOPED SEAL

(75) Inventors: John Alan Eastman, Simpsonville, SC (US); Gary Michael Itzel, Simpsonville, SC (US); Charles Malinowski, Mauldin, SC (US); Victor Morgan, Simpsonville, SC (US); David Richard Johns, Simpsonville, SC (US); Bryan Lewis, Mauldin, SC (US)

(73) Assignee: General Electric Company, Schenectady, NY (US)

( * ) Notice: Subject to any disclaimer, the term of this patent is extended or adjusted under 35 U.S.C. 154(b) by 760 days.

(21) Appl. No.: 11/806,140

(22) Filed: May 30, 2007

(65) Prior Publication Data

US 2008/0298956 A1 Dec. 4, 2008

(51) Int. Cl.
*F01D 25/24* (2006.01)

(52) U.S. Cl. ..... 415/173.1; 415/173.3; 415/214.1

(58) Field of Classification Search ..... 415/173.1, 415/173.3, 173.6, 209.2, 209.3, 214.1
See application file for complete search history.

(56) References Cited

U.S. PATENT DOCUMENTS 3,623,736 A 11/1971 Petrie
5,641,267 A 6/1997 Proctor et al.
5,954,476 A * 9/1999 Stewart et al. ..... 415/214.1
6,126,389 A 10/2000 Burdgick
6,390,769 B1 5/2002 Burdgick et al.
6,402,466 B1 6/2002 Burdgick et al.
6,435,823 B1 8/2002 Schroder
6,638,012 B2 10/2003 Bekrene
6,726,448 B2 4/2004 McGrath et al.
6,814,538 B2 11/2004 Thompson
6,984,106 B2 1/2006 Thompson
7,117,983 B2 10/2006 Good et al.
7,600,967 B2 * 10/2009 Pezzetti et al. ..... 415/173.1

* cited by examiner

*Primary Examiner*—Edward Look
*Assistant Examiner*—Dwayne J White
(74) *Attorney, Agent, or Firm*—Nixon & Vanderhye PC

(57) ABSTRACT

A stator shroud segment is provided that includes an outer shroud having a leading edge groove and a trailing edge groove; and a plurality of inner shrouds each having a leading edge hook and a trailing edge hook, the leading and trailing hooks of each of the inner shrouds being respectively engaged with the leading and trailing edge grooves of the outer shroud so as to axially and radially lock the inner shrouds to the outer shrouds. At least one of the trailing edge hook of the inner shroud and the trailing edge groove of the outer shroud includes a sloped surface disposed at an angle to an axial direction of the rotor and to a radial direction of the rotor and facing the other of the inner and outer shrouds whereby a radial inward force on the inner shroud is transformed into a force in axial and radial directions to force the inner shroud to tightly seal a radial gap between the inner and outer shrouds.

10 Claims, 4 Drawing Sheets

SHROUD CONFIGURATION HAVING SLOPED SEAL

BACKGROUND OF THE INVENTION

In an industrial gas turbine, shroud segments are fixed to turbine shelf hooks in an annular array about the turbine rotor axis to form an annular shroud radially outwardly and adjacent the tips of buckets forming parts of the turbine rotor. The inner wall of the shroud defines part of the gas path. Conventionally, the shroud segments are comprised of inner and outer shrouds provided with complimentary hooks and grooves adjacent their leading and trailing edges for joining the inner and outer shrouds to one another. The outer shroud is, in turn, secured to the turbine shell or casing hooks. In an example configuration, each shroud segment has one outer shroud and two or three inner shrouds.

BRIEF DESCRIPTION OF THE INVENTION

The invention uses the pressure gradient that exists between the flow path aft of the bucket and the shroud cooling air to allow the trailing edge hook to seal more effectively. More specifically, the invention takes the pressure gradient that would normally generate a force in the radial direction and transforms it to a force in the axial and radial directions through the use of at least on sloped surface. The slope is housed in the trailing edge of the inner shroud and outer shroud and is positioned in such a fashion, in an example embodiment, that the pressure gradient will force the inner shroud to move slightly in the direction of the gas path and towards the center of the engine. This movement will force the inner shroud to tightly seal the radial gap between the inner shroud and outer shroud.

Thus, the invention may be embodied in a stator shroud of a multi-stage gas turbine comprising: a shroud segment having a surface for in part defining a hot gas path through one stage and overlaying tips of buckets of said one stage forming part of the turbine rotor, said shroud segment having a leading, upstream edge and a trailing, downstream edge; said shroud segment comprising an outer shroud and at least one inner shroud connected thereto; said outer shroud having a groove defined adjacent and along each of said leading and trailing edges thereof, said groove along said trailing edge opening in an axially upstream direction; said inner shroud having a leading edge axially projecting hook portion and a trailing edge axially projecting hook portion for respectively engaging said grooves of said outer shroud, said engagement axially and radially locking said inner shroud to said outer shroud; and wherein at least one of said trailing edge hook of said inner shroud and said trailing edge groove of said outer shroud includes a sloped surface disposed at an angle to an axial direction of said rotor and to a radial direction of said rotor and facing the other of said inner shroud and outer shroud whereby a radial inward force on said inner shroud is transformed into a force in axial and radial directions to force the inner shroud to tightly seal a radial gap between said inner and outer shrouds.

BRIEF DESCRIPTION OF THE DRAWINGS

These and other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
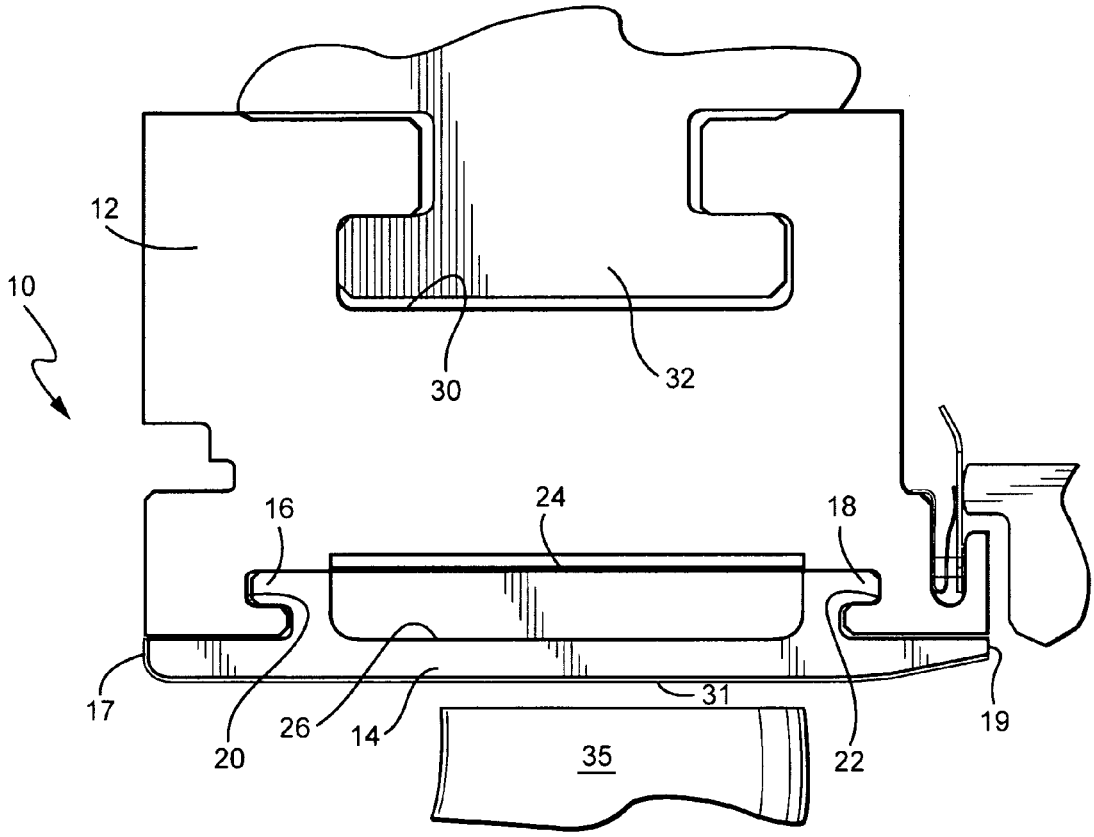
Fig. 1 Prior Art
FIG. 1 is a schematic circumferential end view showing a conventional inner shroud retention design.

Referring to FIG. 1, there is illustrated a shroud segment generally designated 10, comprised of an outer shroud 12 and one of a plurality of inner shrouds 14 for securement to the outer shroud 12. The inner shrouds have hooks 16,18 adjacent their leading and trailing edges 17,19, respectively, for circumferential slidable engagement in grooves 20,22 of the outer shroud 12 in final assembly. The inner and outer shrouds also mount an impingement cooling plate 24 between the shrouds for impingement cooling of the wall surfaces 26 of the inner shroud segments. The outer shroud 12 has a radially outward dovetail groove 30 for receiving a hook 32 forming part of the fixed turbine shell for securing the shroud segment 10 to the shell. It will be appreciated that an annular array of shroud segments 10 are formed about the rotor of the gas turbine and about the tips of the buckets 35 on the rotor thereby defining an outer wall or boundary 31 for the hot gas flowing through the hot gas path of the turbine. Other features and details of the example shroud assembly of FIG. 1 are disclosed in U.S. Pat. No. 6,402,466, the disclosure of which is incorporated herein by this reference.

Figure 2:
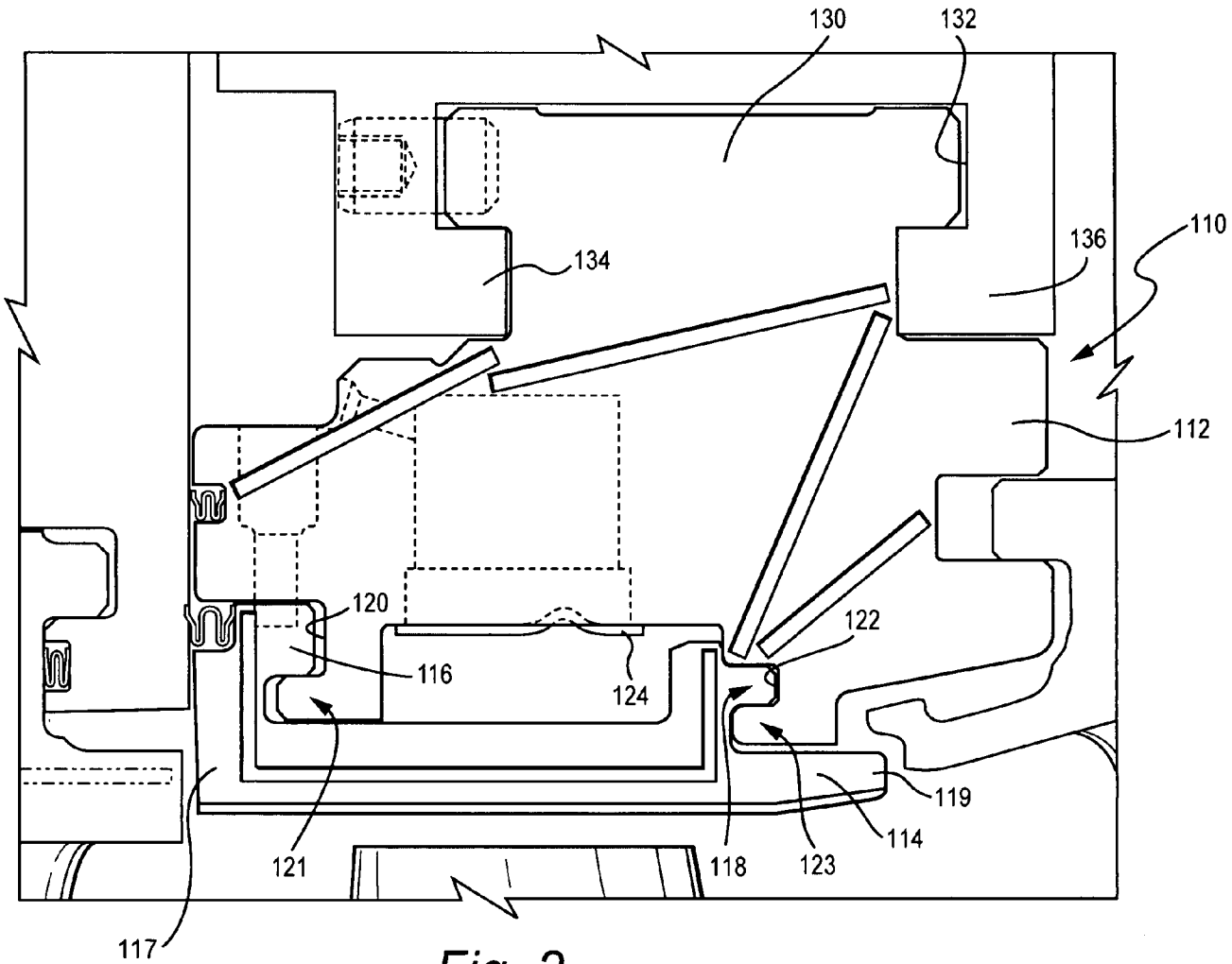
Fig. 2 Prior Art
FIG. 2 is a schematic circumferential end view of another conventional shroud segment.

FIG. 2 illustrates another example shroud assembly. As illustrated therein, a shroud segment, generally designated 110 is comprised of an outer shroud 112 and a plurality of inner shrouds 114. Typically two or three shrouds are provided, only one of which is shown for clarity. The inner shrouds have hooks 116,118 adjacent their leading and trailing edges 117,119 respectively for circumferentially slidable engagement in grooves 120,122 defined by the hooks 121,123 of the outer shroud 112 in final assembly. In the illustrated embodiment, an impingement cooling plate 124 is mounted between the shrouds for impingement cooling of the inner wall of the surfaces of shroud segment 110 in a conventional manner.

In the illustrated example, the outer shroud 116 has a radially outward dovetail 130 for engagement in a dovetail groove 132 defined by leading and trailing hooks 134,136 forming part of the fixed turbine shell or casing for securing the shroud segment to the casing. Known alternatives to the illustrated configuration would include an outer shroud provided with a radially outer dovetail groove for receiving a correspondingly shaped dovetail formed as a part of the turbine casing, as in FIG. 1.

As in the structure shown in FIG. 1, in the FIG. 2 assembly, an annular array of shroud segments 110 are formed about the rotor of the gas turbine and about the tips of the buckets on the rotor thereby defining an outer wall or boundary for the hot gas flowing through the hot gas path of the turbine. Other features of the structure illustrated in FIG. 2 are disclosed in U.S. Pat. No. 6,814,538, the disclosure of which is incorporated herein by this reference.

Figure 3:
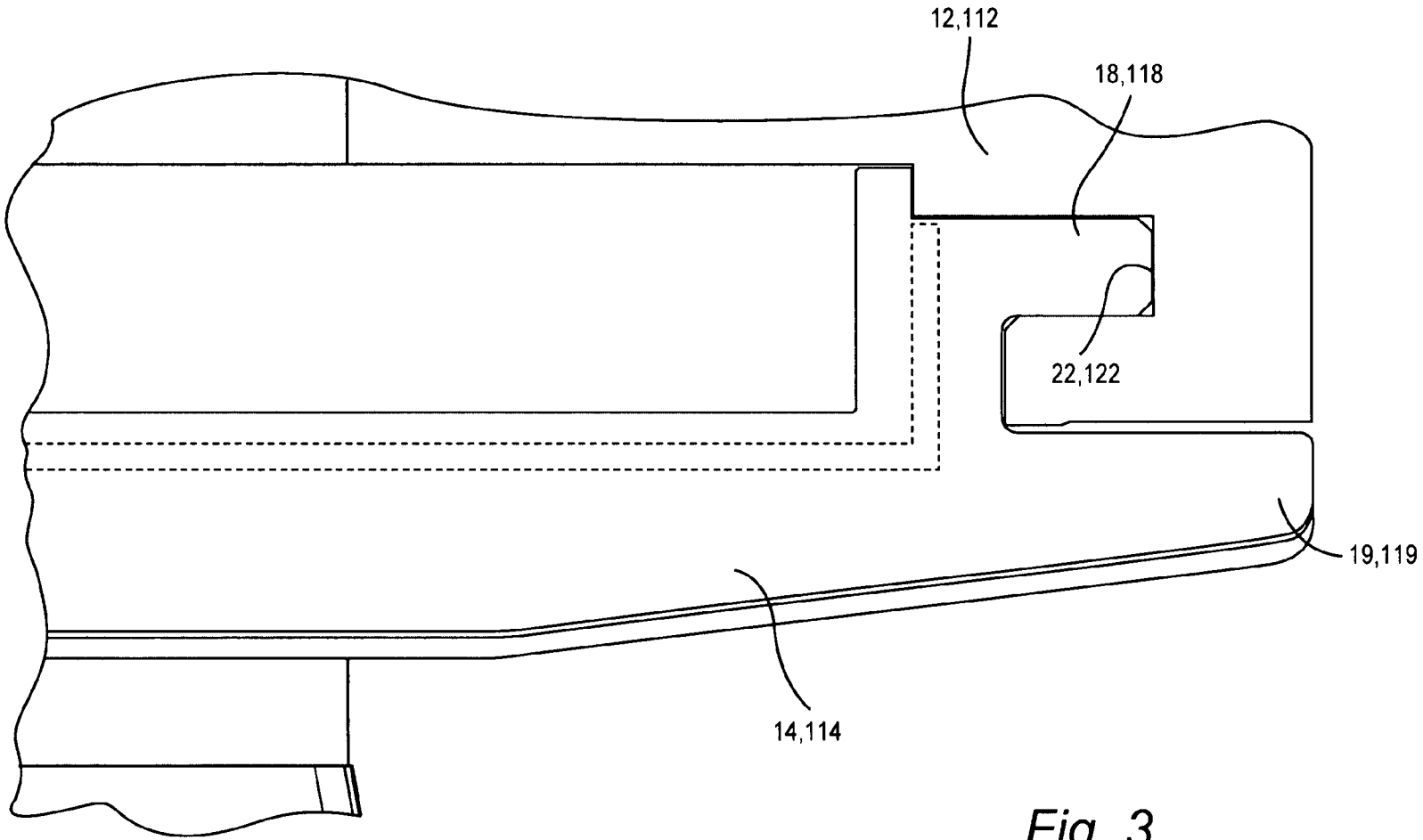
Fig. 3 Prior Art
FIG. 3 is an enlarged schematic circumferential end view of the shroud segment trailing end corresponding to conventional shroud retention designs of FIGS. 1 and 2.

FIG. 3 is an enlarged view of the shroud trailing edge in the shroud configurations of FIGS. 1 and 2 for comparison with the invention, an embodiment of which is described herein below.

Traditional shroud hooks use axial and radial (vertical and horizontal) hook components as in the shroud assemblies shown in FIGS. 1 and 2. The pressure gradient between the cooling air within the shroud assembly and the flow path seals exerts force on the circumferential/axial surface. This circumferential or axial surface is not an effective sealing surface due to the chording of the inner shroud. More specifically, the chording bows the inner shroud to a greater extent than the outer shroud and opens a gap in the axial seal.

The invention uses the pressure gradient that exists between the flow path aft of the bucket and the shroud cooling air to allow the trailing edge hook to seal more effectively. The higher effectiveness seal decreases the gap between the inner and outer shrouds which in turn decreases the amount of cooling flow lost through this particular seal. More specifically, the invention takes the pressure gradient that would normally generate a force in the radial direction and transforms it to a force in the axial and radial directions through the use of the sloped surfaces. The slope is housed in the trailing edge of the inner shroud and outer shroud and is positioned in such a fashion, in an example embodiment, that the pressure gradient will force the inner shroud to move slightly in the direction of the gas path and towards the center of the engine. This movement will force the inner shroud to tightly seal the radial gap between the inner shroud and outer shroud.

Thus and more specifically, to ensure contact along the seal and an effective seal at the aft hook, in an example embodiment of the invention, a sloped, conical component is incorporated in the seal that transfers the pressure loading from purely a radial force to a radial and axial force. Thus, as an embodiment a stator shroud generally of the type illustrated in FIGS. 1 and 2 is provided wherein at least one of the trailing edge hook of the inner shroud and the trailing groove of the outer shroud includes a sloped surface disposed at an angle to an axial direction of said rotor and to a radial direction of the rotor and facing the other of said inner shroud and outer shroud.

Figure 4:
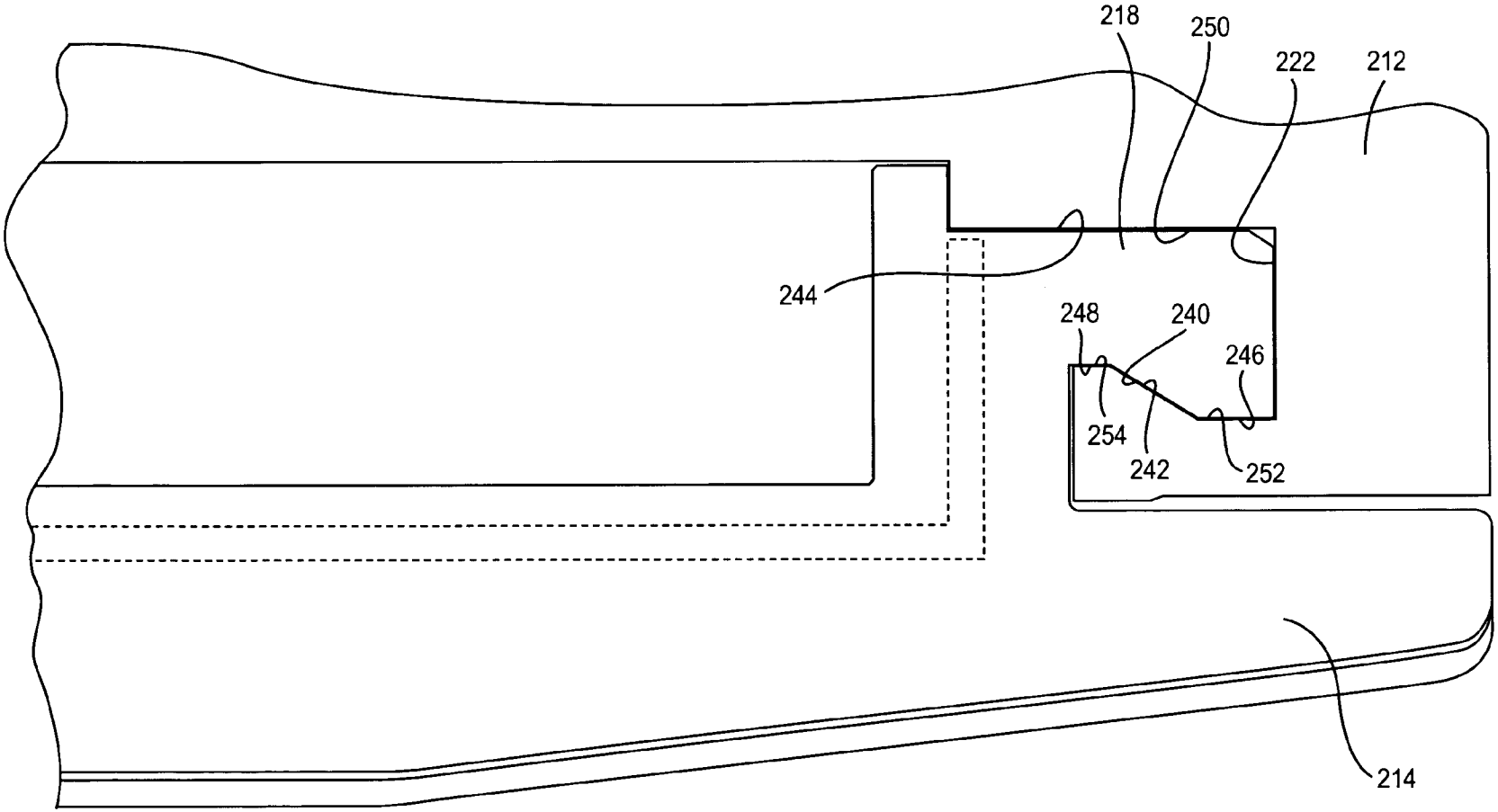
FIG. 4 is an enlarged schematic circumferential end view of a shroud segment embodying the invention.

In an example embodiment, as illustrated in FIG. 4, the inner shroud hook 218 at the aft or trailing end 219 of the inner shroud 214 includes an inclined surface 240 that is inclined with respect to the axis of the rotor and with respect to the radial direction of the rotor. More specifically, the inner shroud hook 218 includes an inclined surface 240 that faces axially forwardly and radially inwardly. Furthermore, the axially forward facing groove 222 of the outer shroud 212 includes a correspondingly inclined surface 242 that faces radially outwardly and in an axially aft or rearward direction. Consequently, the axial force acts on the inner shroud 214 and forces the shroud to move the amount required to make contact with the outer shroud 212. When the machine is running, there will always be a pressure gradient at this location so the inner shroud seal will be constantly loaded in the closed position.

Thus, the invention transfers the loading from purely radial to a combination of axial and radial and forces the inner shroud to seal the radial gap between the inner and outer shrouds. In this way, the pressure gradient forces a tight seal in the radial direction (due to the axial force) instead of in the axial/circumferential direction. Seals in the axial/circumferential direction are not effective seals because of the chording effect of the inner and outer shroud as mentioned previously.

In the illustrated example, the trailing edge hook 218 of the inner shroud 214 comprises a radially outer circumferential surface 244 and a radially inner circumferential surface. The radially inner circumferential surface is comprised of the sloped surface 240 and a first surface 246 generally parallel to the axial direction of the rotor. In this example, the hook 218 further comprises a second surface 248 parallel to the axial direction and on an opposite axial side of the sloped surface 240 with respect to the first surface 246. On the other hand, the radially outer circumferential surface 244 of the hook 218 extends axially along substantially an entire axial length of the hook 218.

In the illustrated example, the trailing edge groove 222 of the outer shroud 212 comprises a radially outer circumferential surface 250 and a radially inner circumferential surface. The radially inner circumferential surface is comprised of the sloped surface 242 and a first surface 252 generally parallel to the axial direction of the rotor. In this example, the groove 222 further comprises a second surface 254 parallel to the axial direction and on an opposite axial side of the sloped surface 242 with respect to the first surface 252. On the other hand, the radially outer circumferential surface 250 of the groove 222 extends axially along substantially an entire axial length of the groove 222.

As will be appreciated, there are other possible geometries of the outer shroud and inner shroud interface that could use the sloped hook concept of the invention to seal the aft end of the shroud in addition to the illustrated embodiment. Thus, the invention is embodied in the use of a sloped seal to decrease the effective gap in the seal, but is not limited to the particular location or configuration of the sloped seal illustrated or the respective configurations of the inner and outer shroud hooks and grooves.

Thus, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A stator shroud of a multi-stage gas turbine comprising:

a shroud segment having a surface for in part defining a hot gas path through one stage and overlaying tips of buckets of said one stage forming part of the turbine rotor, said shroud segment having a leading, upstream edge and a trailing, downstream edge;

said shroud segment comprising an outer shroud and at least one inner shroud connected thereto;

said outer shroud having a groove defined adjacent and along each of said leading and trailing edges thereof, said groove along said trailing edge opening in an axially upstream direction;

said inner shroud having a leading edge axially projecting hook portion and a trailing edge axially projecting hook portion for respectively engaging said grooves of said outer shroud, said engagement axially and radially locking said inner shroud to said outer shroud; and wherein at least one of said trailing edge hook of said inner shroud and said trailing edge groove of said outer shroud includes a sloped surface disposed at an angle to an axial direction of said rotor and to a radial direction of said rotor and facing the other of said inner shroud and outer shroud whereby a radial inward force on said inner shroud is transformed into a force in axial and radial directions to force the inner shroud to tightly seal a radial gap between said inner and outer shrouds.

2. A stator shroud as in claim 1, wherein each of said trailing edge hook and trailing edge groove include respectively complimentary sloped surfaces disposed at an angle to an axial direction of said rotor and to a radial direction of said rotor and facing the other of said inner shroud and outer shroud.

3. A stator shroud as in claim 1, wherein said trailing edge hook of said inner shroud comprises a radially outer circumferential surface and a radially inner circumferential surface, and wherein said radially inner circumferential surface is comprised of said sloped surface and a first surface generally parallel to said axial direction.

4. A stator shroud as in claim 3, wherein said trailing edge hook further comprises a second surface parallel to said axial direction on an opposite axial side of said sloped surface with respect to said first surface.

5. A stator shroud as in claim 1, wherein said sloped surface faces radially inwardly and axially forward.

6. A stator shroud as in claim 3, wherein the radially outer circumferential surface of the trailing edge hook extends axially along substantially an entire axial length of the trailing edge hook.

7. A stator shroud as in claim 1, wherein said trailing edge groove of said outer shroud comprises a radially outer circumferential surface and a radially inner circumferential surface, and wherein said radially inner circumferential surface is comprised of said sloped surface and a first surface generally parallel to said axial direction.

8. A stator shroud as in claim 7, wherein said trailing edge groove further comprises a second surface parallel to said axial direction on an opposite axial side of said sloped surface with respect to said first surface.

9. A stator shroud as in claim 7, wherein said sloped surface faces radially outwardly and axially rearwardly.

10. A stator shroud as in claim 7, wherein the radially outer circumferential surface of the trailing edge groove extends axially along substantially an entire axial length of the trailing edge groove.

* * * * *